US005915707A

United States Patent [19]

Steffen

[11] Patent Number: 5,915,707

[45] Date of Patent: Jun. 29, 1999

[54] SKATE-BOARD FOR RECLINED USE

[76] Inventor: Nathan S. Steffen, 12606 SE Ramona, Portland, Oreg. 97236

[21] Appl. No.: 08/678,773

[22] Filed: Jul. 11, 1996

[51] Int. Cl.[6] ..... B62B 11/00

[52] U.S. Cl. ..... 280/87.03; 280/87.01

[58] Field of Search ..... 280/87.01, 87.041, 280/87.042, 87.021, 87.03, 13–18; 188/16, 17, 19, 20, 21

[56] References Cited

U.S. PATENT DOCUMENTS

| | | | |
|---|---|---|---|
| 1,724,564 | 12/1929 | Craig | 280/87.01 |
| 3,671,055 | 6/1972 | Aarup | 280/87.01 |
| 4,134,599 | 1/1979 | DiMille et al. | 280/87.01 |
| 4,384,731 | 5/1983 | Webb | 280/87.01 |
| 4,875,694 | 10/1989 | Hamrick | 280/87.01 |
| 5,354,081 | 10/1994 | Huffman et al. | 280/87.01 |

*Primary Examiner*—Richard M. Camby
*Attorney, Agent, or Firm*—Birdwell & Janke, LLP

[57] ABSTRACT

An improved skate-board for reclined use. A substantially thin board has a cross-section that is curved to be ergonomically advantageous for reclined use. The board is broader than and extends laterally beyond its operator. The board includes two skate wheel trucks either or both of which may employ bicycle-type hand brakes wherein, preferably, the brake pads are removed. The board includes upwardly projecting hand grips aiding the operator to control the board and to operate the hand-brakes, the hand levers of which are attached thereto. The board further includes laterally disposed downwardly projecting skid runners for protecting the board during cornering. The board still further includes heel guides proximate the position of the operator's feet, for helping maintain the operator's feet inboard of the skate-board.

13 Claims, 2 Drawing Sheets

SKATE-BOARD FOR RECLINED USE

BACKGROUND OF THE INVENTION

This invention relates to skate-boards, particularly skate-boards which support a user operating the skate-board while reclining.

Skate-boards have long been enjoyed for providing inexpensive and relatively thrilling sport that simulates surfing but that can be carried out in virtually any urban environment. There have been relatively few attempts to modify the skate-board concept to permit reclining use, which, rather than simulating surfing, more closely simulates luge. In the reclined position, greater speeds may be reached owing to significantly diminished wind resistance. Moreover, the operator's proximity to the ground enhances the sensation of speed. However, along with these advantages come increased dangers. Greater speed is more difficult to control safely and poses a greater threat to an operator who loses control. The reclined position does not permit the operator the same degree of visibility as would be afforded by standing, further lessening the operator's ability to control the skate-board. It is also inherently more difficult to steer such a skate-board, since steering a skate-board is generally accomplished by leaning one's center of mass in one direction or the other. This movement can be accomplished to a greater extent while standing simply as a result of the operator having greater leverage.

Moreover, the greater speed provides the user the capability to enjoy higher cornering forces. However, for the same reason that leaning is more effectively accomplished while standing, it is relatively more difficult for the reclining operator to resist high cornering forces and therefore remain on the skate-board while being subject thereto. Besides making it more difficult for the operator to steer so as to achieve the cornering forces, the reclined position tends to make it relatively more difficult for the operator to remain on the board at a given cornering force.

Also with greater speed and higher cornering forces, a skate-board is subject to increased tilting while cornering. If a skate-board is narrow, such tilting exposes the operator's limbs to the danger of striking the ground. If the skate-board is broad, so as to extend beyond and thereby protect the operator, the skate-board itself is subject to damage.

A prior art reclinable skateboard is proposed by Webb, U.S. Pat. No. 4,384,731 ("Webb"). Webb discloses an elongated board structure having a headrest connected to the rear of the board and two foot rests connected at the front of the board, the foot rests being elevated from the board to assist steering of the board.

Webb, in many respects, typifies the problems encountered in such skate-boards. The platform is flat, while the human operator's profile is not. This leads to inevitable discomfort and fatigue. Webb provides a head-rest, but resting the head is inconsistent with efficient operation of such a skate-board. Webb provides for steering with the feet. But steering a skate-board is accomplished by leaning body mass, and there is a greater body mass in the torso than in the legs and feet. Therefore, steering control is not optimized. Webb exposes the upper torso of the operator to danger. Moreover, Webb does not propose a means for stopping the skate-board. Stopping a conventional skate-board is usually easily accomplished by jumping off. However, a reclining operator does not have this stopping means at his or her disposal.

Accordingly, there is a need for a novel improved skate-board for reclining use that provides for increased cornering facility, increased control for both moving and stopping, increased safety, improved ergonomics, and better protection against the dangers of enthusiastic use.

SUMMARY OF THE INVENTION

The improved skate-board for reclined use of the present invention solves the aforementioned problems and meets the aforementioned need by employing a board of curvilinear cross-sectional shape adapted to conform to the natural curvature of a reclining operator's body, the board having a plan form which is width-wise dimensionally greater and than the plan form of the operator reclining thereon and extends outwardly therefrom to define a border which substantially contains the operator. The cross-sectional shape of the board tends to raise the operator's head with respect to the operator's knees, curves concavely downwardly to fit the operator's spine, curves convexly upwardly from the operator's seat to the back of the operator's knees, and curves downwardly therefrom toward the operator's feet.

A bottom surface of the board includes front and back bosses, the back boss being disposed proximate the operator's head position and the front boss being disposed proximate the operator's foot position. The bosses project downwardly from the bottom surface of the board in cooperation with the cross-sectional shape of the board to position the operator with respect to the road surface as aforedescribed.

The bosses provide mounts for associated front and back skate wheel assemblies, each assembly having a wheel pair connected through a short axle, the axle allowing limited transverse rotation of the wheel assemblies with respect to the skate-board to permit cornering or turning by leaning, and being positioned on the bosses for rolling the skate-board in the direction faced by the operator.

The bottom surface also includes a pair of downwardly projecting skid runners, preferably positioned at laterally outboard edges of the border. The skid runners protect the skate-board from contact with the road surface during cornering and help the operator maintain control of the board during a skid.

The wheel assemblies include bicycle-type brake mechanisms, preferably with their brake pads removed, each mechanism being operably connected via a cable to respective hand levers. The hand levers are attached to respective hand-grip bars projecting upwardly from the skate-board for gripping by the right and left hands of the operator, for helping the operator maintain position within the confines thereof.

The skate-board includes heel guides proximate the position of the operator's feet, for helping maintain the operator's feet inboard of the skate-board.

Therefore, it is a principal object of the present invention to provide a novel improved skate-board for reclined use.

It is another object of the present invention to provide such an improved skate-board which provides for increased operator safety.

It is a further object of the present invention to provide such an improved skate-board which provides for increased cornering facility.

It is yet another object of the present invention to provide such an improved skate-board which provides for increased control for both moving and stopping.

It is still another object of the present invention to provide such an improved skate-board which provides for improved ergonomics.

It is a further object of the present invention to provide such an improved skate-board which provides for improved self-protection.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
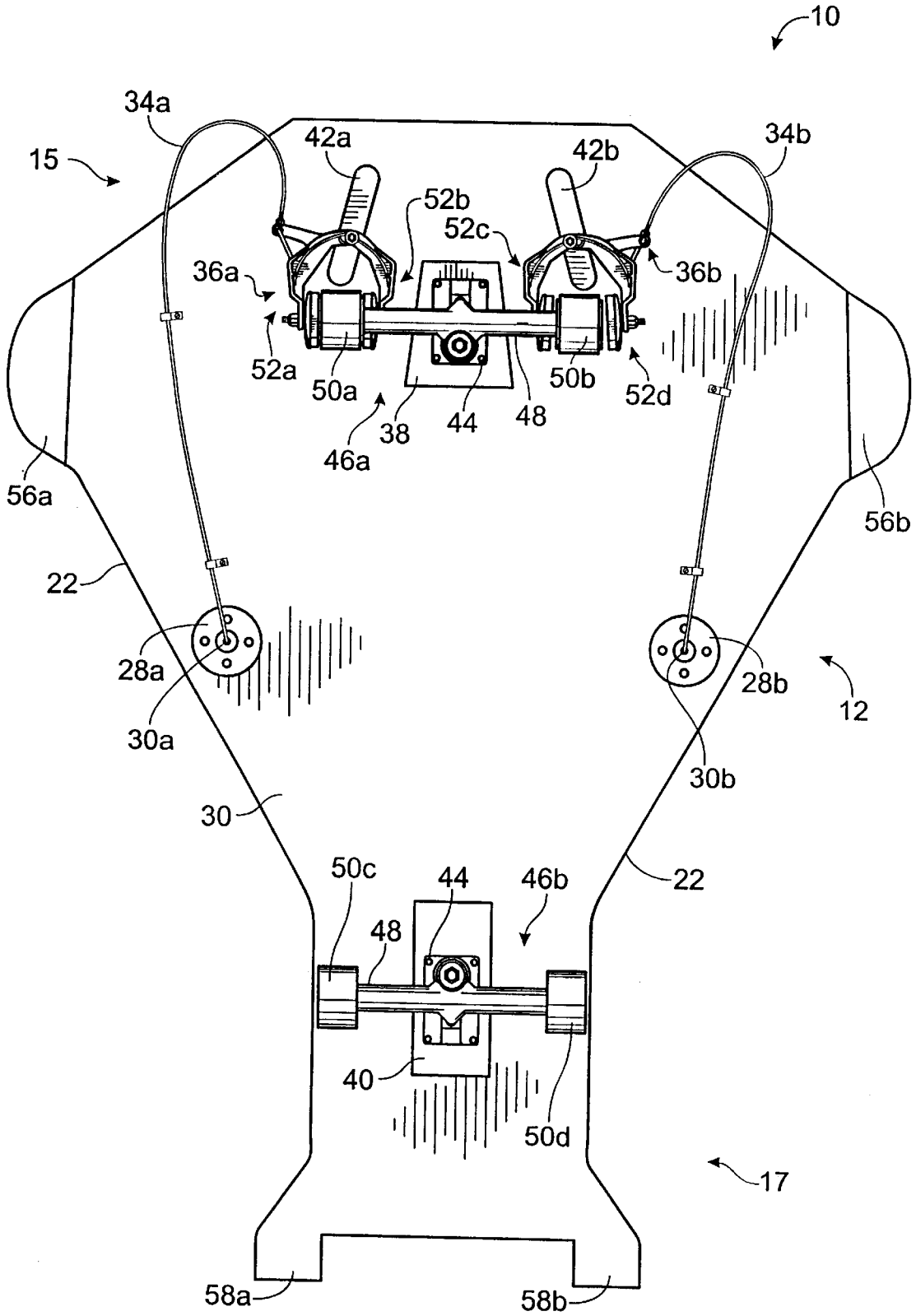
FIG. 1 is a bottom view of an improved skate-board for reclined use according to the present invention.
Figure 2:
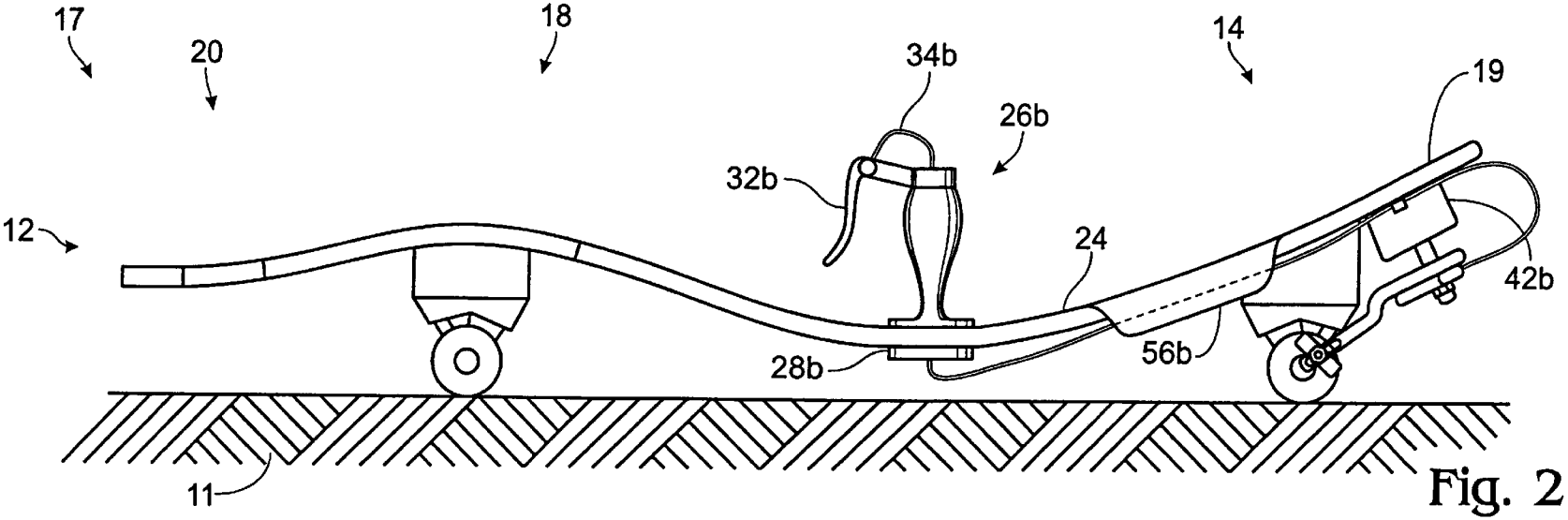
FIG. 2 is a side elevation of the improved skate-board of FIG. 1.

Referring to FIGS. 1 and 2, a preferred embodiment of an improved skate-board 10 for reclined use for riding on a road surface 11 comprises a board 12 of a smoothly varying curvilinear cross-sectional shape 19. The curvilinear cross-sectional shape is selected to position an operator of the skate-board optimally for operating the skate-board and to be ergonomically advantageous by substantially conforming to the natural curvature of the operator's reclined body. The board 12 will be described hereinafter as being divided into portions; however, it will be understood that these descriptions are intended as an aid to describing the shape of the board rather than to reflect any structural discontinuities. Thence, the board 12 includes a back portion 14, a seat portion 16, a back-of-the-knee portion 18 and a lower leg portion 20. All of the portions are, preferably, wider than the width of the corresponding portions of the operator's body, to permit the operator to be contained within a border 22 defining the plan shape and perimeter of the board 12. This protects the operator against side-impacts while riding the skate-board 10.

The board has a substantially thin cross-section 19. The cross-section 19 is defined by the curvature of the back portion 14, the seat portion 16, the back-of-the-knee portion 18 and the lower leg portion 20 as follows: The seat portion 16 is concave from the point of view of the operator, and defines a lowest elevation of the board 12 with respect to the road surface 11. The back portion 14 smoothly joins the seat portion 16 and curves upwardly and away from the seat portion toward a proximal end 15 of the board 12, to support the upper torso in a slightly raised position. The back portion 14 defines at its end, the proximal end 15. The proximal end 15 preferably reaches to about the location of the operator's shoulders. On the other side of the seat portion 16, the back-of-the-knee portion smoothly joins the seat portion and is substantially convex from the point of view of the operator to permit the operator to maintain comfortably a slightly bent leg, which aids the operator's responsiveness. On the other side of the back-of-the-knee portion 18, the lower leg portion 20 smoothly joins the back-of-the-knee portion and, preferably, substantially continues the curvature of the back-of-the-knee portion proximate thereto. The back-of-the-knee portion has a reduced curvature tending toward a substantially level orientation at a distal end 17 of the board 12 where the operator places his or her feet. All of the portions 14, 16, 18 and 20 are joined to form the smoothly varying curvilinear cross-section 19.

The board 12 is preferably constructed of laminated wood veneer, as will be described more fully below.

The operator reclines on a top surface 24 of the board 12. Left and right hand grips 26*a*, 26*b* project upwardly from the top surface 24 proximate the seat portion 16 at laterally outboard positions thereof. The hand grips are spaced so that the operator may be seated therebetween. The hand grips provide the operator a means to transmit force to the board 12 and thereby to help steer the board and to help the operator remain thereon, especially during cornering and stopping.

The hand grips may be formed, for example, of ⅜"×6" plumbing nipples over which a rubber grip, such as the type employed for bicycle hand grips, is placed. When plumbing nipples are used, a corresponding threaded flange 28*a*, 28*b* is fastened to a bottom surface 30 of the board 12, the nipple extending through an aperture 30*a*, 30*b* in the board 12 and into the threaded flange. Other structures providing equivalent function may be used with departing from the principles of the invention.

Hand levers 32*a*, 32*b* are advantageously attached to the hand grips 26*a* and 26*b*. The hand levers are preferably the same type employed for bicycle brake mechanisms and are connected through respective cables 34*a*, 34*b* to respective bicycle-type brake mechanisms 36*a*, 36*b* attached to the bottom surface 30 of the board. Preferably, the cables are passed to the bottom surface through the hand grips.

The bottom surface 30 includes a head boss 38, disposed at the proximal end 15 of the board, a tail boss 40, disposed at the distal end 17 of the board, and two brake bosses 42*a*, 42*b*, disposed proximate the head boss. The bosses project from the surface 30 to such an extent as to cooperate with the board 12 to achieve the aforedescribed cross-section 19. The bosses are preferably constructed of suitably sized blocks of wood and are attached to the board by screws 44 of suitable length.

The head boss 38 and the tail boss 40 each carry a skate wheel truck 46*a*, 46*b* comprising a semi-flexibly mounted axle 48 at each end of which is disposed a rotatably mounted skate wheel 50*a* and 50*b*, and 50*c* and 50*d*, respectively. Preferably, the skate wheels are formed of a hard plastic and employ ball-bearing races. Such wheel trucks 46*a* and 46*b* are available commercially as complete assemblies which include the aforementioned components. Preferably, the trucks are mounted to the bosses 38, 40 with the same screws 44 that attach the bosses to the board 12.

The aforedescribed brake mechanisms 36*a*, 36*b* are mounted, respectively, on the brake bosses 42*a*, 42*b*, so that the skate wheel 50*a* is disposed between calipers 52*a* and 52*b* of the mechanism 36*a*, and the skate wheel 50*b* is disposed between the calipers 52*c*, 52*d* of the mechanism 36*b*. It has been found that the calipers 52*a*–52*d* work best with the brake pads which are typically provided with the mechanisms 36*a*, 36*b* are removed therefrom. Thence, the calipers 52*a*–52*d* are caused, by gripping the associated hand levers 32*a*, 32*b* and thereby pulling the attached associated cables 34*a*, 34*b*, to directly contact sides 54*a*, 54*b* of the wheel 50*a* and sides 54*c*, 54*d* of the wheel 50*b*.

It is preferable to provide a brake mechanism 36*a*, 36*b* for the wheel truck 46*a* mounted to the head boss 38, because the board 12 is broader at the head boss 38 and, therefore, there is more room for the bosses 42*a*, 42*b* and the associated brake mechanisms. However, brake mechanisms could be provided for the wheel truck 46*b*, mounted to the tail boss 40, or one brake mechanism could be provided to each wheel truck without departing from the principles of the present invention.

The bottom surface 30 also includes a pair of downwardly projecting skid runners 56*a*, 56*b*, preferably positioned at laterally outboard edges of the border 22. The skid runners have a surface friction characteristic that tends to permit the skid runners to slide on the road surface 11 when the board 12 is leaned sufficiently during cornering to initiate contact. Thence, the skid runners tend to protect the board bottom surface 30 from damage as well as help the operator maintain control of the board during a skid. The skid runners are generally elongate and are preferably formed of blocks of wood which may be attached to the board by adhesive or by screw-type fasteners.

Figure 3:
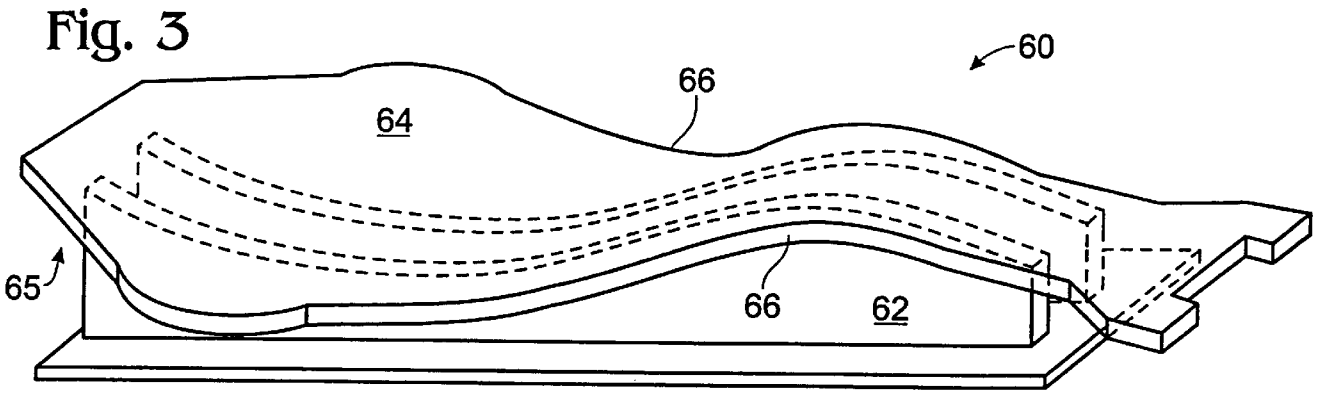
FIG. 3 is a side elevation of a method of manufacturing the improved skate-board of FIG. 1.

The board 12 includes heel guides 58*a*, 58*b* at the distal end 17 thereof. Preferably, the heel guides are integrally formed with the board, as part of the plan shape thereof. The heel guides extend longitudinally, away from the distal end 17, at laterally outboard positions of the lower leg portion 20. The heel guides are positioned proximate the operator's feet, for helping the operator maintain his or her feet inboard of the skate-board. Referring to FIG. 3.

The board 12 is preferably constructed of five layers of ⅛" thick sheets of wood veneer, cut to define the border 22. Each layer is treated with an adhesive and overlaid with another of the layers to form the board 12. With all the layers having therebetween the adhesive, the board 12 is laid out on a form 60. The form 60 is provided having the plan shape and cross-sectional contour of the board 12, the form being raised on a complementary pedestal 62 to provide stiffness to the form 60, and to provide clearance, at all locations thereon, for a standard "C" clamp tool 61 (not shown). The bottom surface 30 of the board 12, corresponding to the bottom of the bottom-most layer, is laid on a top surface 64 of the form 60 with the "C" clamps 61 making contact between the top surface 24 of the board 12 and a bottom surface 65 of the form 60. The clamps 61 are spaced at suitable intervals around a perimeter 66 of the form 60 and the adhesive is allowed to cure while the board is being held to the form 60 thereby. Preferably, the cure time of the adhesive is selected so that the adhesive does not set prior to clamping the board 12 to the form 60, but sets soon thereafter.

It is to be recognized that, while a specific improved skate-board for reclined use has been shown as preferred, other configurations could be utilized, in addition to configurations already mentioned, without departing from the principles of the invention. Particularly, the board 12 may have other ergonomically desirable contours and may be formed of other materials and by other methods, including plastic formed, e.g., by vacuum molding. Moreover, the bosses 38, 40, 42*a*, 42*b* as well as the skid runners 56*a* and 56*b* may be formed integrally with the board 12.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

I claim:

1. An improved skate-board for use by an operator in a reclined position, said skate-board comprising:

a pair of skate wheel trucks, each of said skate wheel trucks including an axle and a pair of skate wheels, said skate wheels being spaced apart at opposite ends of said axle and being rotatably mounted to said axle so as to roll in a rolling direction substantially perpendicular thereto; and a board having an elongate axis substantially parallel to said rolling direction, a bottom surface, a top surface, a back portion and a seat portion disposed adjacent said back portion, said pair of skate wheel trucks being mounted on said bottom surface so that said skate wheel trucks are spaced apart along said elongate axis and said elongate axis is substantially aligned with said rolling direction of said skate wheel trucks, wherein said back portion is adapted to receive the operator's torso on said top surface when the operator is in the reclined position, wherein said seat portion is adapted to receive the operator's seat on said top surface when the operator is in the reclined position, wherein said seat portion defines a first elevation, said back portion and said seat portion being joined to form a substantially smoothly varying curvilinear shape in cross-section, said back portion curving upwardly of said seat portion to a second elevation greater than said first elevation so that said back portion raises the operator's torso with respect to the operator's seat.

2. The skate-board of claim 1, further comprising a back-of-the-knee portion, wherein said back-of-the-knee portion is adapted to receive the back of the operator's knees on said top surface when the operator is in the reclined position, wherein said seat portion is disposed between said back portion and said back-of-the-knee portion, said portions forming a smoothly varying curvilinear shape in cross-section, said back-of-the-knee portion curving upwardly from said seat portion to a third elevation greater than said first elevation so that said back-of-the-knee portion raises the operator's knees with respect to the operator's seat.

3. The skate-board of claim 2, wherein said third elevation is less than said second elevation, so that said back portion raises the operator's torso with respect to the operator's knees.

4. The skate-board of claim 2, further comprising a lower leg portion, wherein said lower leg portion is adapted to receive the operator's lower legs on said top surface when the operator is in the reclined position, wherein said back-of-the-knee portion is disposed between said seat portion and said lower leg portion, said portions forming a smoothly varying curvilinear shape in cross-section, said lower leg portion curving downwardly from said back-of-the-knee portion to a fourth elevation less than said third elevation so that said back-of-the-knee portion raises the operator's knees with respect to the operator's lower legs.

5. The skate-board of claim 4, wherein said fourth elevation is less than said second elevation, so that said back portion raises the operator's torso with respect to the operator's lower legs.

6. The skate-board of claim 5, wherein said fourth elevation is greater than said first elevation, so that said lower leg portion raises the operator's lower legs with respect to the operator's seat.

7. The skate-board of claim 1, wherein said top surface extends laterally beyond the operator's torso to protect the operator from side-impacts.

8. The skate-board of claim 1, further comprising brake means for braking the skate-board, said brake means being operably disposed about at least one of said skate wheels of at least one of said skate wheel trucks, said brake means including operating means for operating said brake means accessible from said top surface by the operator while in the reclined position.

9. The skate-board of claim 8, wherein said operating means includes a pair of disposed on a respective pair of hand-grips extending upwardly from said top surface and being disposed at laterally outboard positions of said seat portion.

10. The skate-board of claim 8, wherein said brake means includes a bicycle type hand-brake disposed about said one of said skate wheels, said bicycle type hand-brake having a pair of removable brake pads, said brake pads being removed.

11. The skate-board of claim 1, further comprising downwardly-extending board protection means for protecting said board during cornering.

12. The skate-board of claim 1, further comprising a pair of runners downwardly depending from said bottom surface at a respective pair of laterally outboard positions of said back portion to protect the skate-board from damage and to help the operator maintain control of the thereof during a skid.

13. The skate-board of claim 1, further comprising a pair of hand-grips depending upwardly from said top surface and being disposed at laterally outboard positions of said seat portion, to help the operator control the skate-board.

* * * * *